US005211567A

United States Patent [19]

Neumann et al.

[11] Patent Number: 5,211,567

[45] Date of Patent: May 18, 1993

[54] METALLIZED CONNECTOR BLOCK

[75] Inventors: Eugene F. Neumann; Melvin C. August; Stephen A. Bowen; Gregory W. Pautsch, all of Chippewa Falls, Wis.

[73] Assignee: Cray Research, Inc., Eagan, Minn.

[21] Appl. No.: 725,007

[22] Filed: Jul. 2, 1991

[51] Int. Cl.[5] ..... H01R 9/09

[52] U.S. Cl. ..... 439/74; 439/75; 439/608; 439/908

[58] Field of Search ..... 439/65, 66, 74, 75, 439/101, 109, 608, 654, 908

[56] References Cited

U.S. PATENT DOCUMENTS

| | | | |
|---|---|---|---|
| 2,163,412 | 6/1939 | Schneider . | |
| 2,694,799 | 11/1954 | Del Camp . | |
| 2,969,251 | 1/1961 | Scoville . | |
| 3,022,480 | 2/1962 | Tiffany . | |
| 3,097,032 | 7/1963 | Hochheiser . | |
| 3,212,049 | 10/1965 | Mittler et al. . | |
| 3,333,225 | 7/1967 | McNutt . | |
| 3,459,998 | 8/1969 | Facarile . | |
| 3,568,011 | 3/1971 | Straus . | |
| 3,670,409 | 6/1972 | Reimer . | |
| 3,744,128 | 7/1973 | Fisher et al. . | |
| 3,757,276 | 9/1973 | Kailus . | |
| 3,832,603 | 8/1974 | Cray et al. . | |
| 3,851,221 | 11/1974 | Beaulieu et al. . | |
| 3,876,822 | 4/1975 | Davy et al. . | |
| 3,904,934 | 9/1975 | Martin . | |
| 3,958,851 | 5/1976 | Evans . | |
| 3,999,830 | 12/1976 | Herrmann, Jr. . | |
| 4,054,939 | 10/1977 | Ammon . | |
| 4,208,080 | 6/1980 | Leagno . | |
| 4,283,754 | 8/1981 | Parks . | |
| 4,295,184 | 10/1981 | Roberts . | |
| 4,352,533 | 10/1982 | Murase et al. . | |
| 4,403,823 | 9/1983 | Reimar | 439/908 |
| 4,468,076 | 8/1984 | Hine et al. . | |
| 4,505,532 | 3/1985 | Hine et al. . | |
| 4,514,784 | 4/1985 | Williams et al. . | |
| 4,574,236 | 3/1986 | Hechtman . | |
| 4,700,996 | 10/1987 | August et al. . | |
| 4,712,849 | 12/1987 | Seidel et al. . | |
| 4,720,770 | 1/1988 | Jameson . | |
| 4,724,180 | 2/1988 | Kern . | |
| 4,734,046 | 3/1988 | McAllister et al. . | |
| 4,734,058 | 3/1988 | Paulacka . | |
| 4,797,113 | 1/1989 | Lambert . | |
| 4,806,111 | 2/1989 | Nishi et al. . | |
| 4,813,128 | 3/1989 | Massopust . | |
| 4,884,168 | 11/1989 | August et al. . | |
| 4,939,624 | 7/1990 | August et al. | 439/75 |
| 4,961,709 | 10/1990 | Noschese . | |
| 4,991,645 | 3/1990 | August et al. . | |
| 5,037,332 | 8/1991 | Wilson | 439/608 |

FOREIGN PATENT DOCUMENTS

| | | | |
|---|---|---|---|
| 3005634 | 8/1981 | Denmark | 439/74 |
| 0039175 | 11/1981 | European Pat. Off. . | |
| 0243021 | 10/1987 | European Pat. Off. . | |
| 0402791 | 12/1990 | European Pat. Off. . | |

OTHER PUBLICATIONS

Article entitled "Connector Interposer for Module to Board Connection" Martyak, Natoli, and Ricci; IBM Technical Disclosure Bulletin, vol. 14, No. 8, Jan. 1972.

IBM® Technical Disclosure Bulletin, entitled "Shielded Connectors", vol. 22, No. 2, dated Jul. 1979, 2 pages.

*Primary Examiner*—Paula A. Bradley

*Attorney, Agent, or Firm*—Merchant, Gould, Smith, Edell, Welter, & Schmidt

[57] ABSTRACT

A completely shielded metallized connector block for use in multiple circuit modules of an electronic device. Electrical communication between the circuit boards is effected by an array of metallic pins which run through the blocks. The metallization on the nonconductive blocks can be held at ground or at a constant potential to increase the shielding between pins as well as maintaining voltage and ground planes at constant levels throughout the modules. The metallization is insulated from the pins and circuit boards by nonconductive bushings inserted in holes in the blocks. In one embodiment, the metallization consists of copper and solder plating and the blocks are constructed of liquid crystal polymer.

12 Claims, 7 Drawing Sheets

METALLIZED CONNECTOR BLOCK

BACKGROUND OF THE INVENTION

1. Field of the Invention

The present invention relates to connector blocks used in the multiple circuit modules of electronic devices such as high-speed digital computers of the type produced by Cray Research, the assignee hereof. Specifically, the present invention relates to shielded connector blocks made of metallized non-conductive materials for multiple circuit modules which provide shielded connector paths between circuit boards.

2. Description of the Prior Art

Circuit boards are utilized in many types of electronic equipment and it is often necessary, particularly in complex equipment, to interconnect the circuit boards into a module, and to interconnect modules into multiple circuit modules. For example, some high-speed electronic digital computers of the type produced by Cray Research, Inc. utilize circuit modules consisting of four circuit boards mounted in close proximity on opposite sides of two cooling plates. Such circuit modules are arranged in banks and it is, therefore, desirable to interconnect adjacent circuit boards within a module in a manner which permits convenient disconnection for service and reconnection after service, and which also permits reversed stacking for testing.

One previously known example of an interconnected multiple circuit module is disclosed in U.S. Pat. No. 4,514,784 to Williams et al. In this apparatus, conductive pins are used to transmit signals from one circuit module to another. Electrical connection between the pins is accomplished by connector blocks positioned between the modules having bores defined therein for receiving the pins. This type of module connection was a great improvement over previous designs because it minimized twisting and misalignment of the connector elements, while facilitating connection over the shortest circuit paths.

However, as the architecture of high-speed electronic digital computers evolves, greater switching speed and circuit density are required. As circuit density increases, a greater number of connections are necessary between modules, thereby increasing the total force needed to connect the modules.

In response to that need, U.S. Pat. No. 4,939,624 to August et al. disclosed an improved interconnected circuit module using connector blocks both between modules and circuit boards within the modules to decrease the total force needed to connect modules while providing an increased number of connections.

As a result of the increased number of connections in the limited space, it became increasingly likely that transmission of a signal through a first circuit path would possibly affect the operation of an adjacent path. This phenomenon is known as cross-talk, and is a major impediment to improved circuit density in high-speed digital computers. The cross-talk problem has two components, capacitive cross-talk and inductive cross-talk. U.S. Pat. No. 4,939,624 attempted to solve that problem by incorporating additional shielding elements in or on the blocks. Such an approach, however, effectively dealt only with capacitive cross-talk and failed with respect to inductive cross-talk. In addition, it added significantly to the cost and complexity of the connector blocks.

It is clear that there has existed an unfilled need for improved connector blocks for use in interconnected multiple circuit modules which reduce the aggregate force necessary for assembly and disassembly while providing adequate shielding to reduce inductive interference between adjacent circuit paths.

SUMMARY OF THE INVENTION

Accordingly, it is an object of the present invention to provide improved connector blocks for use in connecting both circuit boards and modules of circuit boards which offers increased shielding between adjacent signal paths through the connector blocks.

To accomplish that objective, the present invention comprises a connector block apparatus which provides essentially completely shielded operation of adjacent circuit paths due to the electrically conductive nature of the metallized coating formed on the block. The metallizing can be held either at ground or at a constant potential to prevent induction between signal paths.

The advantages of the present invention are available because of the novel use of metallized coatings in conjunction with the nonconductive material of the blocks to allow the blocks to selectively pass electrical signals without shorting the signal in the metallizing formed on the nonconductive block.

In the preferred embodiment, the block is formed of non-conductive material, preferably liquid crystal polymer, which is then metallized. When the blocks are used, the metallizing is held at a constant potential to shield any signals passing through the block. The interior surfaces of any holes formed in the block are also preferably metallized to provide shielding that is essentially coaxial with the signals passing through the block. Where a signal pin passes through the block a non-conductive bushing, preferably made of a low dielectric material, preferably an acetal polymer, is placed in the hole to prevent shorting of the signal in the block. In contrast, constant potential pins passing through the block are placed in electrical contact with the metallizing to transmit the desired potential throughout the module. The outer surfaces of the block are preferably covered with a nonconductive dielectric to prevent shorting of any components on the metallizing.

The present invention offers the advantages of flexibility in the placement of constant potential holes relative to the signal holes formed in the block. That flexibility allows the designer the ability to tailor the shielding to the needs of the signals transmitted through the blocks. In addition, the hole dimensions and materials placed in the holes can be chosen to provide an impedance value desired for the given system.

A multiple circuit module using the present invention includes a plurality of circuit boards arranged in facing pairs, each circuit board having a plurality of pin receiving recesses defined therein; a plurality of cold plates positioned between the circuit boards in each of the facing pairs, respectively, for conducting waste heat away from the circuit boards, each cold plate having an open space defined therein for allowing electronic communication between the circuit boards; a plurality of shield connector blocks positioned within the open spaces, respectively, each having a plurality of through-holes defined therein; at least one dual-entry connector block interposed between two of the circuit board pairs, the connector block having a plurality of connector through-holes defined therein; a plurality of electrically conductive signal pins for conducting electrical signals from one of the circuit board pairs to another of the circuit board pairs, the signal pins being selectively insertable in the pin receiving recesses, the through-bores or the connector bores, depending on the desired path of the signals.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there are illustrated and described preferred embodiments of the invention.

DETAILED DESCRIPTION OF THE PREFERRED EMBODIMENT(S)

Module Construction

Figure 1:
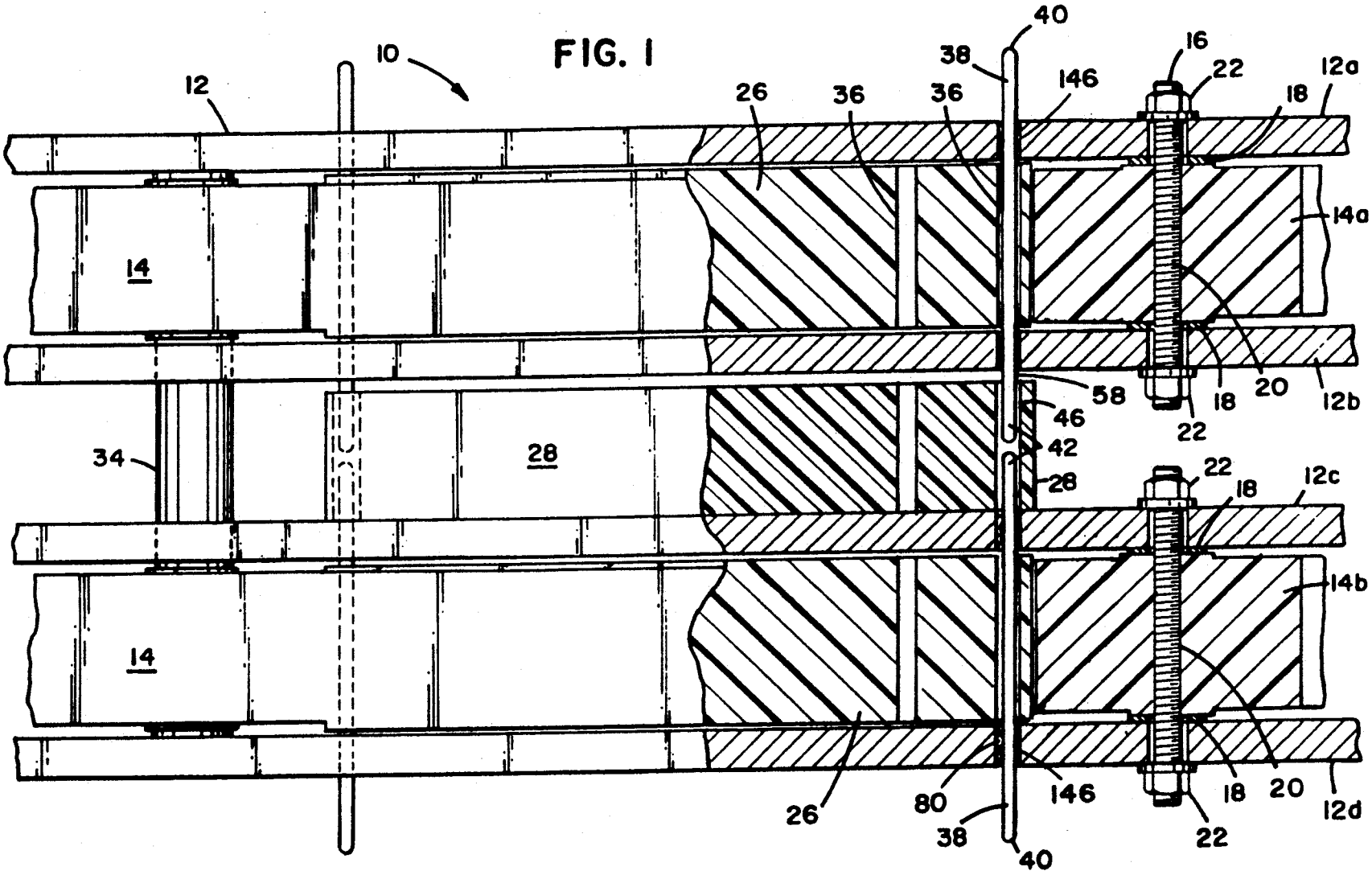
FIG. 1 is a side cutaway view, taken partially in cross-section, of a circuit board module constructed using the connector blocks of the present invention.

Referring now to the drawings, wherein like reference numerals designate corresponding elements throughout the views, and particularly referring to FIGS. 1–6, there is shown an interconnected multiple circuit module 10 utilizing both shield connector blocks 26 and dual-entry connector blocks 28 according to the preferred embodiments of the invention. As is best illustrated in FIG. 1, circuit module 10 includes a plurality of planar circuit boards **12*a* through 12*d*, generally referred to as 12, which are arranged to extend in a parallel, spaced relationship. In order to maintain the circuit boards 12 at a proper operating temperature, pairs of circuit boards 12*a*, 12*b* and 12*c*, 12*d* are disposed about cold plates 14*a* and 14*b* respectively, generally referred to as 14. Cold plates 14 conduct excess heat energy away from the circuit boards as described in U.S. Pat. No. 4,628,407 and as described in U.S. patent application Ser. No. 07/284,992, entitled "Cold Plate With Interboard Connector Apertures for Circuit Board Assemblies", filed on Dec. 14, 1988 and assigned to the assignee of the present patent application. The two pairs of circuit boards 12 disposed about two cooling plates 14 form a single module. Each pair of circuit boards 12 is secured to cold plate 14 by a spacer/connector assembly 16 which includes a pair of spacers 18 disposed between the circuit boards 12 and cold plate 14, a threaded stud 20 and a pair of fastening nuts 22, as is shown in FIG. 1**.

In order to permit communication between circuitry on the various circuit boards 12, a number of open spaces are defined in each of the cold plates 14. Each of the spaces extends through the entire width of the corresponding cold plate 14 and contains a shield connector block 26. Each of the shield connector blocks 26 is provided with an array of through-bores or holes 46 defined therein which may be coincident with pin receiving recesses or bores defined in the attached circuit boards 12. The shield connector blocks 26 are manufactured with a pre-defined array of holes such that all the holes may not be used in a particular application. In the preferred embodiment, the shield connector blocks 26 are constructed of liquid crystal polymer which is metallized to minimize cross-talk between adjacent pins (as described in further detail below). Other materials could be substituted in place of the liquid crystal polymer of the preferred embodiment, providing that the chosen material can be coated with an electrically conductive material.

In order to provide electronic signal, voltage and ground communication between the various circuit boards 12, a plurality of conductive pin members 38 extend through the recesses provided in circuit boards 12 and through the bores 46 in the connector blocks 26. Pins 38 may be electrically connected to circuitry on each of the various circuit boards 12 by removable connectors, by soldering, or such connection may be effected by plating the surfaces defining the pin receiving recesses or holes on circuit boards 12.

In the preferred embodiment, removable connectors 146 are used in the circuit boards 12 and in at least some of the bores 46 in the connector blocks 26, as is further described below. The preferred connectors 146 are Zierick sockets manufactured by the Zierick Company, Radio Circle Drive, Mount Kisco, N.Y. 10549.

A complete circuit module is formed of two pairs of circuit boards **12*a*–12*d*, each pair disposed on both sides of cold plate 14*a* and 14*b*. In cross-section, a half circuit module is formed of a single pair of circuit boards 12, a single cold plate 14 and a shield connector block 26. In order to interconnect two half modules, pins 38 may be provided with first and second end portions 40, 42, respectively, the second ends 42 of which extend outwardly beyond the surfaces of circuit boards 12*b* and 12*c* and have preferred diameters of 0.018" while the remainder of the pins 38** have preferred diameters of 0.012".

As shown in FIG. 1, a dual-entry connector block 28 is freely disposed between a pair of such half modules and has an array of connector through-holes 58 defined therein for receiving end portions 42 of the connector pins 38. For example, as shown in FIG. 1, connector hole 58 receives the second end portion 42 of pin 38 from the upper half module and a corresponding pin end portion 42 from the lower half module so as to electrically connect the two pins 38 by means of a dual entry contact or other suitable means (not shown in FIG. 1, but described in more detail below in conjunction with FIG. 6). The two half modules are secured together by suitable means and spaced apart by means of spacer 34 controlling the amount of space and gaps between the upper and lower half modules.

The shield connector blocks 26 and dual-entry connector blocks 28 are manufactured with a pre-defined array of holes such that all the holes may not be used in a particular placement on the circuit module. In the preferred embodiment, the blocks are constructed of liquid crystal polymer which is metallized to minimize cross-talk between adjacent pins (as described in further detail below). Other materials could be substituted in place of the liquid crystal polymer of the preferred embodiment, providing that the chosen material can be coated with an electrically conductive material.

Ground and voltage connections between circuit boards in a module are typically made between edge connectors and backplanes to supply voltages and ground current return paths for the operating logical circuits located on circuit boards 12. Electrical signals propagating between circuit boards **12*a*–12*d* require that a signal path be established from one board to another and a voltage or ground current return path also exists for the requisite current to flow. Traditionally, the current return paths between circuit boards in a module are supplied through the backplane connections. If, however, the current return paths are electrically stressed in that they are supplying current to a large number of switching circuits simultaneously, the voltage and ground current return paths between remote signal source and signal destination points may experience a shift in overall potential, causing slow gate switching, changing voltage switch thresholds, and lowering of noise margins. To avoid these problems, constant potential openings in the shield and dual-entry blocks provide additional voltage and ground current return paths between circuit boards 12 to further lower the inductance between the voltage and ground return paths between the circuit boards. Thus, the metallized blocks further serve to maintain all the voltage and ground planes on circuit boards 12 at the same relative potential in module 10**.

In addition to maintaining the voltage and ground planes, the metallized coating of the shield and dual-entry blocks effectively eliminates interference between signal pins whether they are connected to ground or to a constant DC voltage source by providing essentially coaxial shielding of the individual pins. As a result, the speed of machines employing such blocks can be increased with less signal disruption due to cross-talk between signals traveling through adjacent paths in the blocks.

An additional advantage of the blocks of the preferred invention is the flexibility allowed in placing the constant potential openings in the blocks for optimal shielding and ground plane maintenance in the half modules and full modules.

For a more complete discussion of the types of pins and other arrangements and details of modular construction as described above, reference can be had to U.S. Pat. No. 4,939,624 issued on Jul. 3, 1990 to August et al., which is hereby incorporated by reference.

Shield Connector Block

Figure 2:
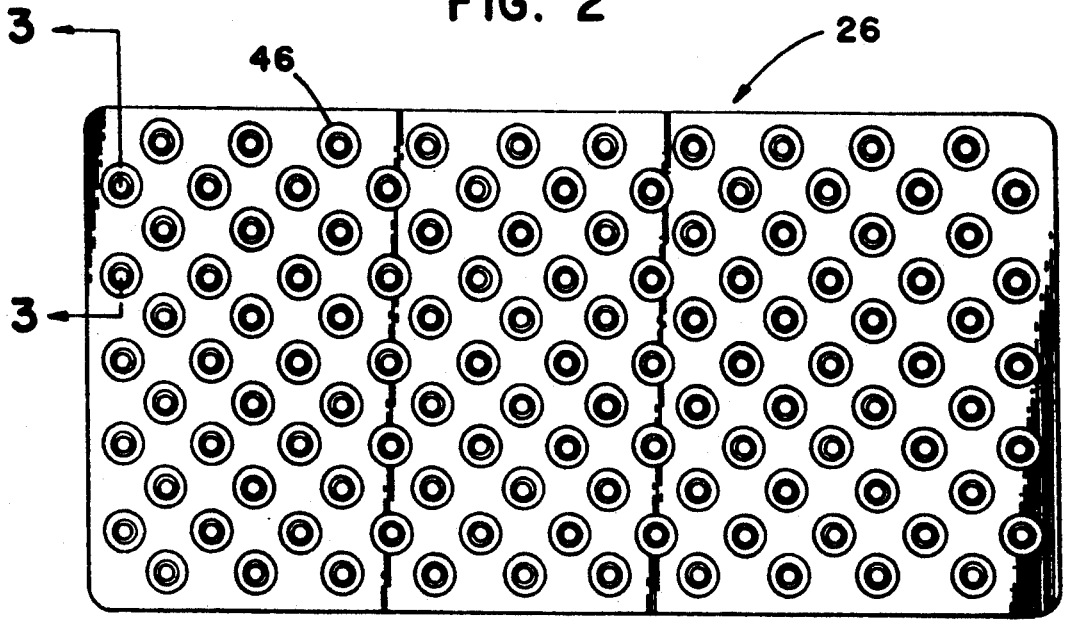
FIG. 2 is a top plan view of a shield connector block according to the embodiment of FIG. 1.
Figure 3:
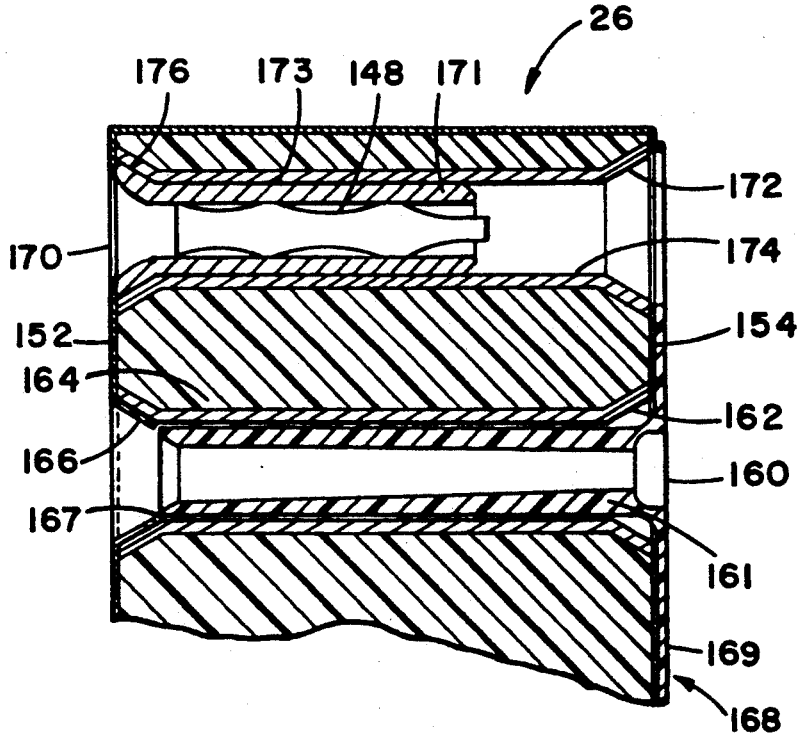
FIG. 3 is a cross-sectional view taken along lines 3—3 in FIG. 2.
Figure 4:
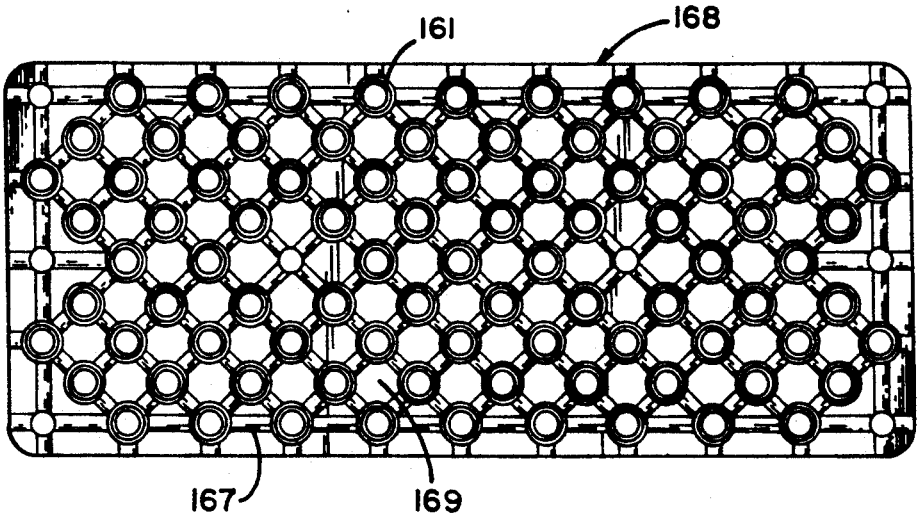
FIG. 4 is a top view of the bushing array used to insulate the signal pin openings of the shield connector blocks.

Referring to FIGS. 2–4, the preferred embodiment of the shield connector block 26 will now be described. The preferred shield connector block 26 has a length of 1.168 inches, width of 0.608 inches and height of 0.245 inches. In one preferred embodiment, the shield block 26 has a total of 115 holes formed therein.

The preferred shield connector blocks are constructed of a nonconductive material such as a liquid crystal polymer. Other materials could be substituted, but the material chosen should have characteristics such that it can be coated with an electrically conductive material.

Connector holes 46 formed in the block 26 may be either of a signal pin opening type 160 or a constant potential opening type 170, which is used to supply a ground or DC voltage connection between the various circuit boards, as discussed above. The holes 46 are arrayed in twenty-one columns spaced on 0.054 inch centers across the block 26 and eleven rows spaced on 0.052 inch centers as shown in FIG. 2. Each column contains either five or six holes 46, with the number of holes in a column alternating across the block 26. The holes 46 in each column are offset with respect to the holes in the adjacent column, also as shown in FIG. 2. Each row contains either ten or eleven holes 46, with the number of holes in a row alternating across the block 26. The holes 46 in each row are offset with respect to the holes in the adjacent row, also as shown in FIG. 2.

The block 26 is preferably molded with all the holes in it. Alternatively, the holes can be formed after the block has been molded. Both the signal pin openings 160 and constant potential openings 170 are formed prior to any plating of the blocks and interior of the openings to provide complete shielding of all the holes.

The preferred signal pin openings 160 are formed with conical recesses on each major side of the block having an outer diameter of 0.063 inches and narrowing down to a diameter of 0.034 inches. The sidewalls 162, 166 of the conical recesses are formed at an angle of 30° off of the longitudinal axis of the opening. Both conical recesses open into a bore 164 having a diameter of 0.034 inches. The bore is formed through the block 26 to connect the conical recesses described above.

All of the outer surfaces and the interior surfaces of the signal openings 160 are metallized to provide the shielding advantages of the present invention. The preferred plating includes a base layer of 50 micro-inch thick copper which is coated with layer of electrolytic solder plating, preferably of a tin-lead (Sn-Pb) composition. Those skilled in the art will understand that a number of other metals and conductive coatings could be substituted in place of those chosen in the preferred embodiment.

To prevent signals traveling through pins in the signal pin openings from shorting out in the metallic plating, each signal pin opening 160 contains a bushing 161 pressed into opening 160. The bushing 161 is made of a non-conductive material, preferably an acetal copolymer. As can be seen in FIG. 3, the preferred bushings 161, are tapered in diameter, such that the inner diameter narrows from 0.024 inches down to 0.017 inches near the base of the bushing array 168 (described below). In addition to preventing electrical shorts, the material and thickness of the bushing 161 and size of the bore 164 can be changed to vary the impedance as desired.

In the preferred embodiment, the bushings 161 inserted into each signal opening 160 of a block 26 are molded into an array 168 having a common section 169 connecting the individual bushings 161 and covering outer surface 154 of block 26 to prevent unwanted electrical contact with the metallic plating coating surface 152. The array 168 is held in place by adhesively bonding it to surface 154.

The array 168 is shown alone in FIG. 4, where it can be seen that the common section 169 is crossed by ridges 167 running between the bases of adjacent bushings 161. The ridges help to provide structural integrity to the array 168 during handling.

The construction of the constant potential openings 170 is similar to that of the signal pin openings 160. The preferred constant potential openings 170 are formed with conical recesses on each major side of the block having an outer diameter of 0.063 inches and narrowing down to a diameter of 0.034 inches. The sidewalls 172, 176 of the conical recesses are formed at an angle of 30° off of the longitudinal axis of the opening. Both conical recesses open into a bore 174 having a diameter of 0.034 inches. The bore is formed through the block 26 to connect the conical recesses described above.

Like the signal pin openings, all of the interior surfaces of the constant potential openings 170 are metallized to provide the shielding advantages of the present invention. The preferred plating includes a base layer of 50 micro-inch thick copper which is coated with layer of electrolytic solder plating, preferably of a tin-lead (Sn-Pb) composition. Those skilled in the art will understand that a number of other metals and conductive coatings could be substituted in place of those chosen in the preferred embodiment.

A conductive bushing 171 is inserted in the opening 170 to connect any pins inserted into the opening 170 with the metallizing on the block 26. In the preferred embodiment illustrated in FIG. 3, the conductive bushing 171 is inserted from the opposite side as the nonconductive bushing 161 in the signal opening 160. The preferred conductive bushing 171 is constructed of brass and has an outer surface 173 flash plated with copper and silver, which is then Sn-Pb solder plated. The interior of the bushing 171 is preferably plated with gold. The bushings 171 are preferably soldered in place in the constant potential openings 170.

In the preferred embodiment, Zierick sockets 148 are placed in the conductive bushings 171 to provide releasable connections between the block 26 and pins 38 of the preferred embodiment while allowing the pins to make electrical contact to maintain the required potential within the half module. The sockets 148 can be best seen in FIG. 3. The sockets 148 remain in place by friction and deformation of the plating inside the bushings 171. The sockets 148 are preferably sized to accept pins with a 0.012" diameter. Although Zierick sockets 148 and conductive bushings 171 are employed in the preferred embodiment, it will be understood that any number of other connection schemes could be employed in their place, providing that electrical connection is made between the constant potential at which the metallizing of the block is held and any pins inserted into the constant potential opening 170.

In the preferred embodiment, the exposed outer surfaces of the block 26 are coated with a dielectric material to prevent unwanted electrical contact between the metallizing on the blocks 26 and any components contacting them. The interior walls 162 of the conical recesses of the signal pin openings 160 are also preferably coated with the dielectric. The preferred dielectric is epoxy-based, but any suitable material can be used.

It will be appreciated by those skilled in the art that the exact number of holes, their spacing and the arrangement of the constant potential openings and signal pin openings in an of the blocks described above can be varied as required in each given application of this technology. Illustrations of the variety of patterns for the 95 and 115 hole blocks presently contemplated are seen in FIGS. 8–12, where holes 120 are constant potential openings and holes 122 are signal pin openings. Any pattern of constant potential openings could be used and the shape of the blocks could also be modified to suit the needs of any particular application.

Dual Entry Connector Block

Figure 5:
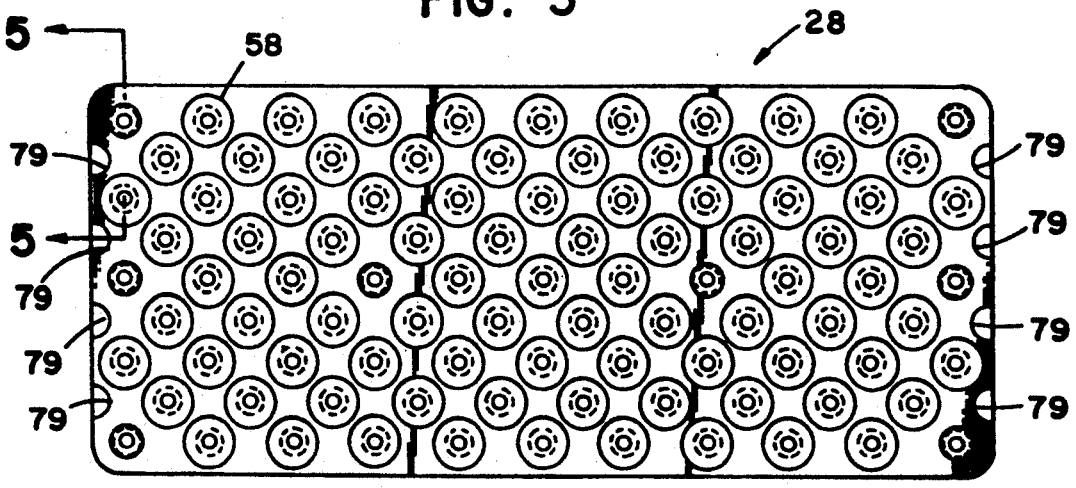
FIG. 5 is a top view of the dual-entry connector block in the embodiment of FIG. 1.
Figure 6:
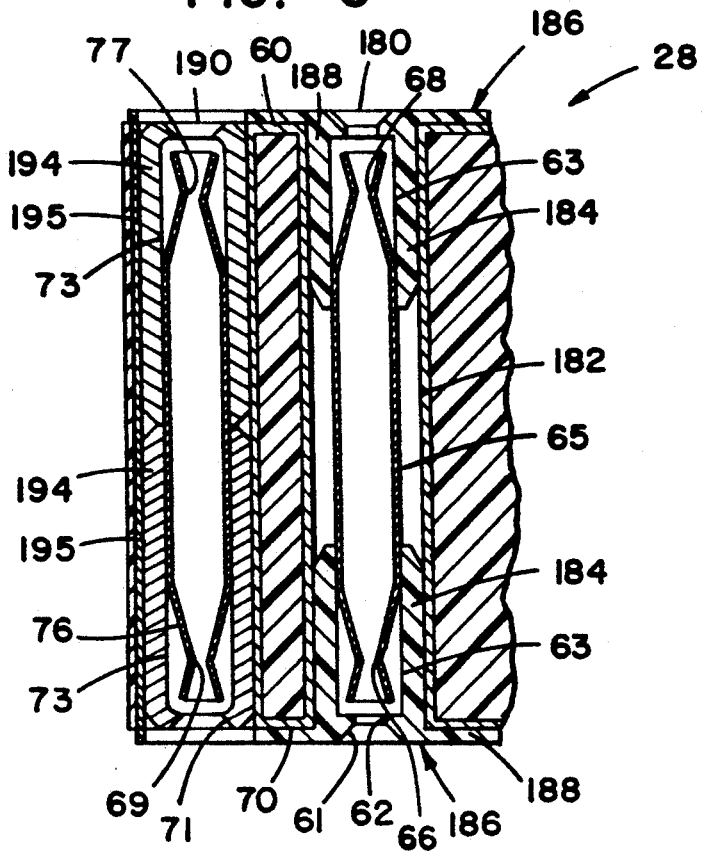
FIG. 6 is a cross-sectional view taken along lines 5—5 in FIG. 4.

Referring to FIGS. 5 and 6, the preferred embodiment of the dual-entry connector block 28 will now be described.

The preferred dual entry block 28 is preferably 1.168 inches long, 0.504 inches wide and 0.393 inches high. In its preferred embodiment, the dual-entry block 28 has a total of 95 holes formed therein. The holes 58 are arrayed in twenty-one columns spaced on 0.054 inch centers across the block 28 and nine rows spaced on 0.052 inch centers as shown in FIG. 5. Each column contains either four or five holes 58, with the number of holes in a column alternating across the block 28. The holes in each column are offset with respect to the holes in the adjacent column, also as shown in FIG. 5. Each row contains either ten or eleven holes, with the number of holes in a row alternating across the block 28. The holes in each row are offset with respect to the holes in the adjacent row, also as shown in FIG. 5.

The block 28 is preferably molded with all of the holes 58 formed in it. Alternatively, the holes can be formed after the block has been molded. Both the signal pin openings 180 and constant potential openings 190 are formed prior to any plating of the blocks and interior of the openings to provide complete shielding of all the holes. The preferred signal pin openings 180 and constant potential openings 190 are formed with a diameter of 0.069 inches.

All of the outer surfaces and the interior surfaces of the signal openings 180 and constant potential openings 190 are metallized to provide the shielding advantages of the present invention. The preferred plating includes a base layer of 50 micro-inch thick copper which is coated with layer of electrolytic solder plating, preferably of a tin-lead (Sn-Pb) composition. Those skilled in the art will understand that a number of other metals and conductive coatings could be substituted in place of those chosen in the preferred embodiment.

To prevent signals traveling through pins in the signal pin openings from shorting out in the metallic plating, each signal pin opening 180 contains a pair of bushings 184 pressed into opening 180 from both ends. The bushings 184 are made of a non-conductive material, preferably an acetal copolymer. In addition to preventing electrical shorts, the material and thickness of the bushings 184 and diameter of the opening 180 can be changed to vary the impedance as desired.

In the preferred embodiment, the bushings 184 inserted into each signal opening 180 of a block 28 are molded into an array 186 having a common section 188 connecting the individual bushings 184 and covering outer surfaces 60 & 70 of block 28 to prevent unwanted electrical contact with the metallic plating coating surfaces 60 & 70. The arrays 186 are preferably held in place by adhesively bonding them to surfaces 60 & 70.

The bushing arrays 186 are constructed substantially the same as the array 168 illustrated in FIG. 4, which has a common section 169 is crossed by ridges 167 running between the bases of adjacent bushings 161. The ridges help to provide structural integrity to the array 168 during handling. The primary difference between bushing arrays 186 and 168 is the length of the bushings 184 & 161, with a pair of bushings 184 being used to insulate a signal pin opening 180 in a dual entry connector block 28, while a single bushing 161 is used to insulate a signal pin opening 160 in a shield connector block 26.

As best shown in FIG. 6, each of the bushings 184 have a conical recess 61 connected to a cylindrical bore 62 which opens into a cavity in the bushing 184 enclosed by a surface 63.

In the preferred embodiment, a contact element 65 is disposed within the bushings 184 placed in signal pin opening 180. The contact element 65 is preferably formed of a resilient, electrically conductive material. Contact element 65 includes an inner surface having contact points 66 and 68 which are adapted to contact the outer surfaces of pins 38 when the pins are inserted into signal pin opening 180. Thus, electric signals may be transmitted from one pin to another when each pin is inserted into an end of the same signal pin opening 180. Contact points 66 and 68 hold pins 38 with different levels of force, with the preferred differential be 1:1.25. It is important that the elements 65 be inserted with the same orientation so that all higher force contact points 68 are on the same side of the block 28. The force differential allows the blocks 28 to be retained in connection with the pins 38 extending from one half module when the halves are separated for repair or maintenance. It will be appreciated by those skilled in the art that the contact element 65 could take many forms. In addition, no contact element could be provided with electrical contact being made between the pins or other conductive members themselves.

The construction of the constant potential openings 190 is similar to that of the signal pin openings 180. Like the signal pin openings 180, all of the interior surfaces of the constant potential openings 190 are metallized to provide the shielding advantages of the present invention. The preferred plating includes a base layer of 50 micro-inch thick copper which is coated with layer of electrolytic solder plating, preferably of a tin-lead (Sn-Pb) composition. Those skilled in the art will understand that a number of other metals and conductive coatings could be substituted in place of those chosen in the preferred embodiment.

In the preferred embodiment, a pair of conductive bushings 194 are inserted in the opening 190 to connect any pins inserted into the opening 190 with the metallizing on the block 28. In the preferred embodiment illustrated in FIG. 6, the conductive bushings 194 are inserted into both ends of the opening 190. The preferred conductive bushing 194 is constructed of brass and has an outer surface 195 flash plated with copper and silver, which is then Sn-Pb solder plated. The interior of the bushings 194 are preferably plated with gold. The bushings 194 are preferably soldered in place in the constant potential openings 190.

The preferred bushings 194, as best shown in FIG. 6, are formed by a conical recess 71 which opens into a larger diameter bore which defines a cavity in the bushing 194 enclosed by surface 73.

In the preferred embodiment, a constant potential contact element 76, preferably made of an electrically conductive resilient material, is disposed within each pair of bushings 194 in opening 190. The contact element 76 includes a pair of inner contact points 69 and 77 which are adapted to contact outer surfaces of any ground or voltage connection pins 38 inserted therein as well as being electrically connected to the plated bore. Contact points 69 and 77 hold pins 38 with different levels of force, with the preferred differential be 1:1.25. It is important that the elements 76 be inserted with the same orientation so that all higher force contact points 69 are on the same side of the block 28 as high force contact points 66 of contact elements 65 in signal pin openings 180. The force differential allows the blocks 28 to be retained in connection with the pins 38 extending from one half module when the halves are separated for repair or maintenance. Thus, ground and voltage connection may be achieved between the various circuit boards 12. It will be appreciated by those skilled in the art that the contact element 76 could take many forms. In addition, no contact element could be provided with contact being made between the pins or other conductive members themselves, in conjunction with the plating and metal of the blocks 28.

The preferred dual-entry connector block 28 also includes extraction slots 79 located at both ends of each half of the block 28. The slots 79 allow precise manipulation of the blocks 28 by an extraction tool used to grasp and remove the block from the pins. In the preferred embodiment, each half contains four slots 79 at each end, the slots being spaced on 0.104 inch centers. Each slot is semicircular, with a diameter of 0.046 inches and is formed to a depth of 0.120 inches as measured from the outer surface of the block 28.

The exposed outer surfaces of the block 28 can be coated with a dielectric material to prevent unwanted electrical contact between the metallizing on the blocks 28 and any components contacting them. The preferred dielectric would be epoxy-based, but any suitable material can be used.

It will be appreciated by those skilled in the art that the exact number of holes, their spacing and the arrangement of the constant potential openings 190 and signal pin openings 180 can be varied as required in each given application of this technology. Illustrations of the variety of patterns for the 95 and 115 hole blocks presently contemplated are seen in FIGS. 8–12, where holes 120 are constant potential openings and holes 122 are signal pin openings.

Method of Manufacture

The preferred method of forming the shield blocks 26 and dual-entry blocks 28 begins with molding the blocks from a suitable nonconductive material, preferably liquid crystal polymer. The blocks are molded with any holes in them. Those skilled in the art will recognize that any nonconductive material could be used to form the blocks, provided that the material can be adequately coated with a conductive material.

After molding, the blocks are coated with a conductive material. In the preferred embodiments, the coating is metallic, preferably consisting of a layer of flash-plated copper having a thickness of 50 micro-inches, followed by a layer of electrolytic solder plating (tin-lead composition) with a thickness of 100–200 micro-inches. The metallizing preferably covers all exposed surfaces of the blocks, including the surfaces inside the holes.

At that point the processing of the shield connector blocks 26 differs from the dual entry connector blocks 28. The shield connector block process will be described first, followed by the dual entry connector block process.

After metallizing, the conductive bushings 171 are pressed into the constant potential holes 170 of the shield blocks 26. Once the bushings 171 are in place, they are reflow soldered into the openings 170.

With the bushings 171 in place, the open ends of the constant potential openings 170 are masked off and the entire block is coated with a dielectric material. The preferred dielectric is a spray-coated epoxy-based dielectric, although any suitable insulating dielectric could be substituted. After coating, the masking is removed from the openings of the bushings 171.

The connectors 148, preferably Zierick sockets as described above, are then inserted into the bushings 171 to provide releasable connections between the metallizing on the block and any pins inserted into the constant potential openings 170.

At this point the nonconductive bushing array 168 is adhesively bonded to surface 154 of block 26. Each bushing 161 is inserted into a corresponding signal pin opening 160. It will be recognized by those skilled in the art that any number of connection methods could be used in place of adhesive bonding to hold the bushing array 168 in place.

The bushing array 168 can be formed of any nonconductive material, although the preferred material will have a low dielectric constant but be mechanically stable to allow handling and easy insertion into the signal pin openings 160. The preferred material is acetal copolymer and the array 168 is preferably formed by molding processes.

After the bushing array is bonded in place, the ends 167 of the bushings 161 are heated to plasticize them, thus "heat staking" the ends 167 of the bushings 161 in place. At this point, the shield connector blocks 26 are complete.

After metallization of the dual entry connector blocks, the preferred method of constructing the blocks 28 continues with placement of the conductive bushings 194 in one end of the constant potential holes 190. The bushings 194 are reflow soldered in place after they have been inserted along one side of the block 28.

With the conductive bushings 194 in place, the bushing array 186 is fitted to the same side of the block 28 as the bushings 194. The array 186 is preferably adhesive bonded to the block 28. It will, however, be recognized by those skilled in the art that any number of connection methods could be used in place of adhesive bonding to hold the bushing array 186 in place.

At that point, contact elements 65 are inserted into bushings 184 that have been placed in the signal pin openings 180. Contact elements 76 are also placed in bushings 194 that have been soldered into position in the block 28. After the contact elements are in place, the opposite set of conductive bushings 194 are placed in the constant potential openings 190, thereby enclosing the contact elements 76 in those openings. This second set of bushings 194 is then reflow soldered in place. Opposite nonconductive bushing array 184 is then fitted to the block 28, thereby enclosing contact elements 65 in the signal pin openings 180. This bushing array 186 is also preferably adhesive bonded to the block 28, although other methods may be employed where appropriate. The bushing arrays 186 preferably cover the two major surfaces of the block 28.

Alternate Embodiments

Figure 7:
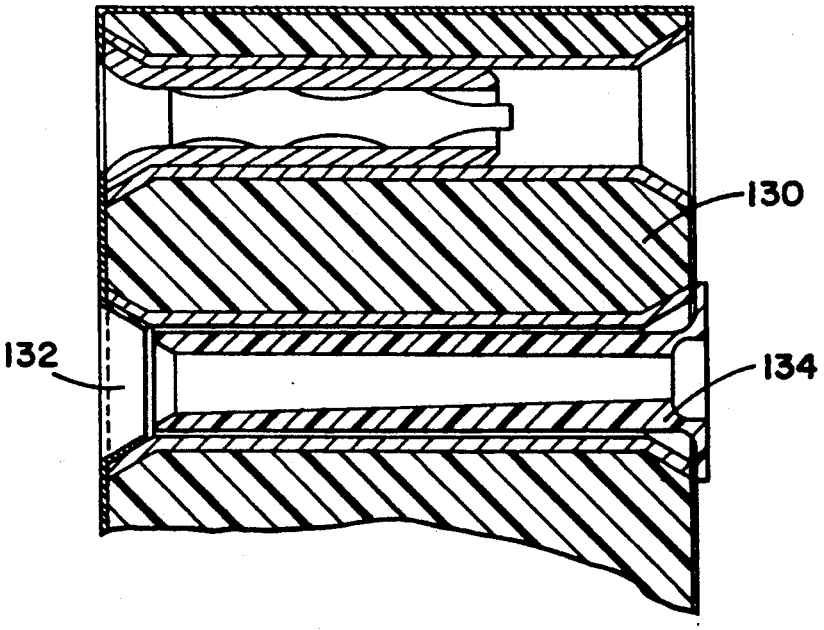
FIG. 7 is a partial cross-section of an alternate embodiment of the shield connector block of the present invention.
Figure 8:
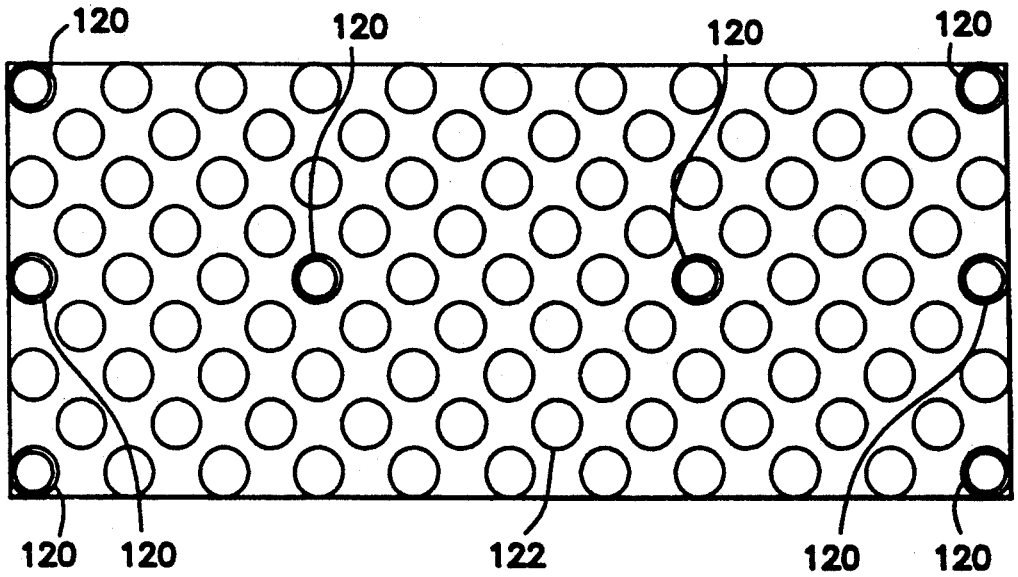
FIG. 8 is a top view of an alternate design of constant potential openings in a 95 hole block.
Figure 9:
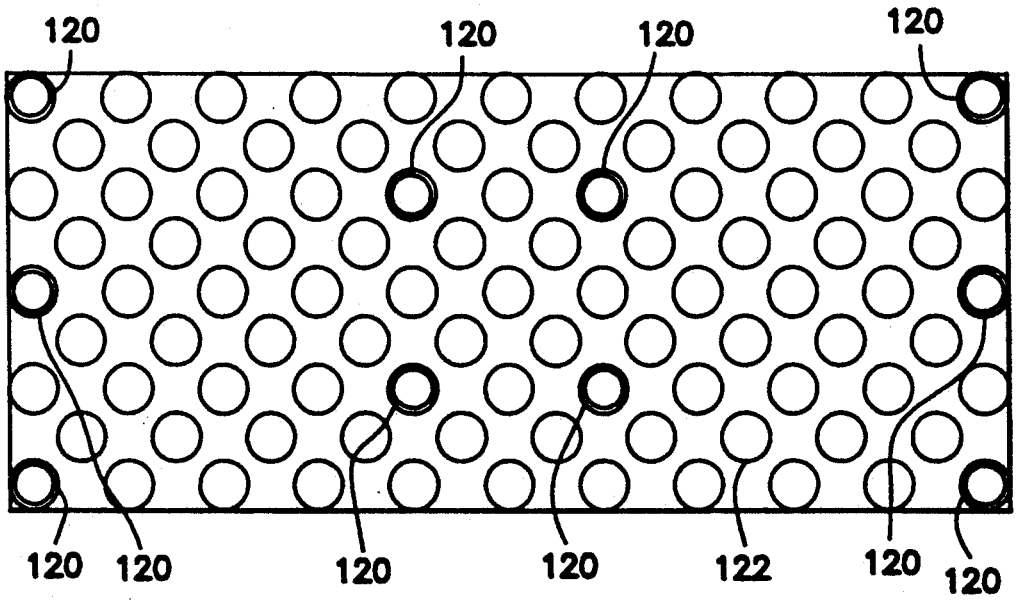
FIG. 9 is a top view of an alternate design of constant potential openings in a 95 hole block.
Figure 10:
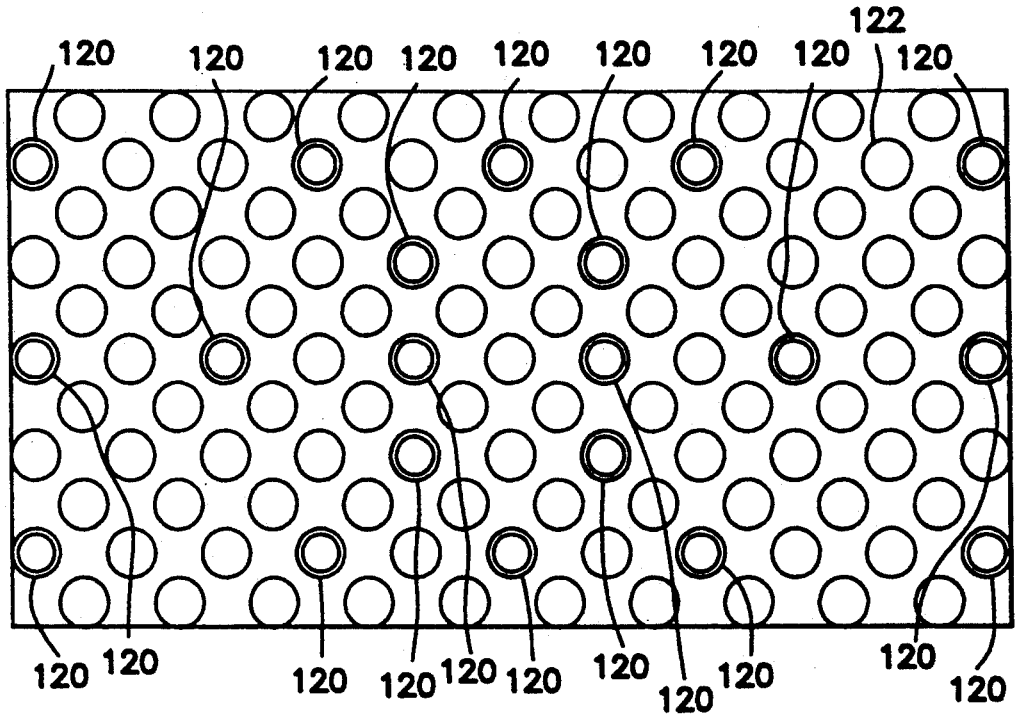
FIG. 10 is a top view of an alternate design of constant potential openings in a 115 hole block.
Figure 11:
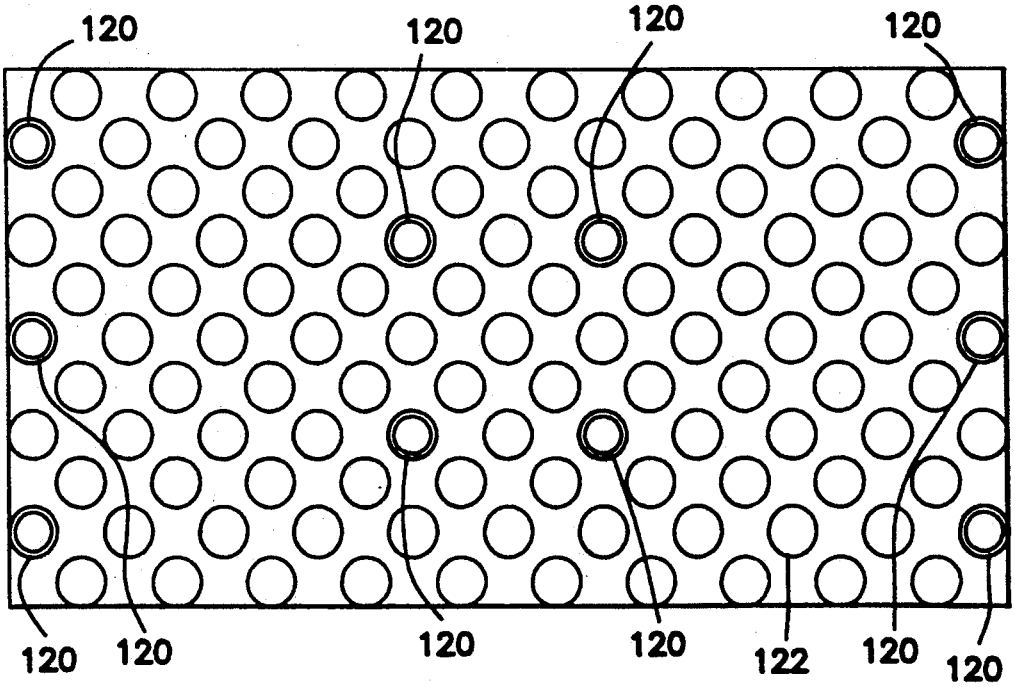
FIG. 11 is a top view of an alternate design of constant potential openings in a 115 hole block.
Figure 12:
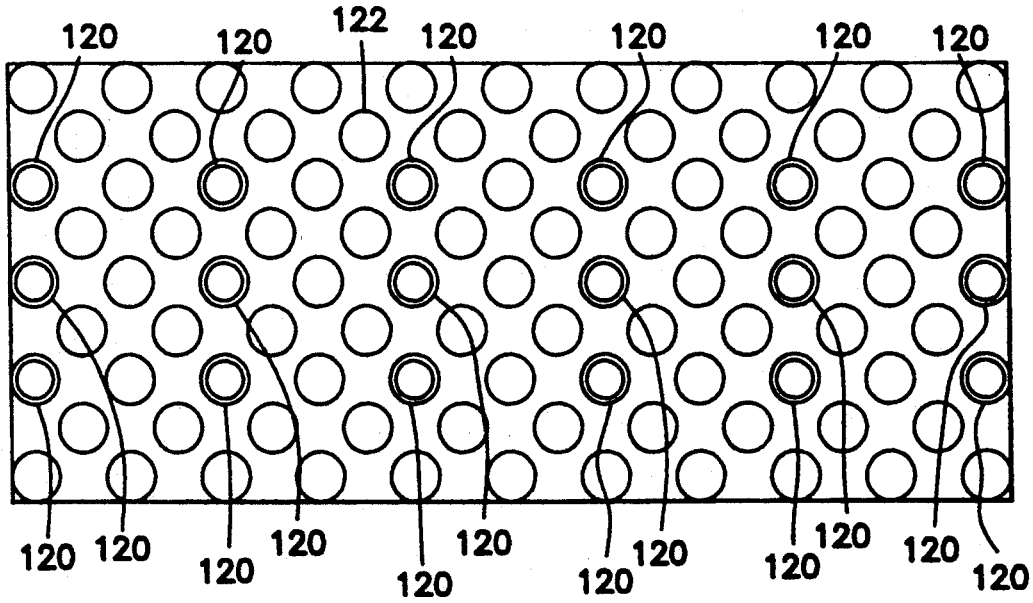
FIG. 12 is a top view of an alternate design of constant potential openings in a 95 hole block.

As illustrated in FIG. 7, an alternate embodiment of either the shield connector block 26 or the dual entry block 28 includes nonconductive bushings 134 that are inserted individually into the signal pin openings 132 of the block 130. Such individual bushings 134 can be adhesively bonded in place or could alternately be heat staked in place.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. A completely shielded connector block apparatus for use in connecting at least two circuit boards via electrically conductive members, comprising:

a body having two substantially parallel exterior faces;

a plurality of holes having interior surfaces, said holes formed through the parallel exterior faces of said body and adapted to receive at least one electrically conductive member;

an electrically conductive coating covering at least the interior surfaces of said holes, said coating being in electrical communication between said plurality of holes; and insulating means in at least one of said holes for insulating any electrically conductive members placed in said holes from said electrically conductive coating.

2. The apparatus of claim 1, wherein said electrically conductive coating further covers at least a portion of the parallel exterior faces of said body.

3. The apparatus of claim 1, wherein said body is constructed of a nonconductive material.

4. The apparatus of claim 3, wherein said nonconductive material is liquid crystal polymer.

5. The apparatus of claim 1, wherein said electrically conductive coating comprises metallizing.

6. The apparatus of claim 5, wherein said metallizing comprises a first layer of copper and a second layer of electrolytic solder plating.

7. The apparatus of claim 1, wherein said insulating means comprises nonconductive bushings.

8. The apparatus of claim 7, wherein said nonconductive bushings are constructed of an acetal copolymer.

9. The apparatus of claim 7, wherein each of said bushings has an inner diameter that narrows along the longitudinal axis of the bushing.

10. The apparatus of claim 7, wherein a plurality of said bushings are connected so as to form an array having a common section between bushings.

11. The apparatus of claim 10, wherein the common section covers at least a portion of one of the parallel exterior faces of said body.

12. The apparatus of claim 10, further comprising a plurality of bushing arrays, each array having a common section adapted to cover at least a portion of one of the parallel exterior faces of said body.

* * * * *

UNITED STATES PATENT AND TRADEMARK OFFICE

CERTIFICATE OF CORRECTION

PATENT NO. : 5,211,567

DATED : May 18, 1993

INVENTOR(S) : Eugene F. Neumann, et al

It is certified that error appears in the above-identified patent and that said Letters Patent is hereby corrected as shown below:

Title Page:

In (75), Inventors, delete "Stephen A. Bowen; Gregory W. Pautsch,all" after name "August:" insert --Daniel C. Mansur, Jim Falls, Wis.; Albert H. Wilson, Los Angeles, CA-- after the word "Wis." therefore.

In column 1, line 9, insert --Inc.-- after the word "Research" therefore.

In columns 3, lines 65 and 66, "patent application" should read -- Patent Application-- therefore.

In column 4, line 48, insert --a-- after the word "of" therefore.

In columns 6, 7, 8 and 9, lines 45, 24, 45 and 44 respectively, insert --a-- after the word "of" therefore.

In column 8, line 2, "in an" should read --in and-- therefore.

UNITED STATES PATENT AND TRADEMARK OFFICE

CERTIFICATE OF CORRECTION

PATENT NO. : 5,211,567

DATED : May 8, 1993

INVENTOR(S) : Eugene F. Neumann, et al.

It is certified that error appears in the above-identified patent and that said Letters Patent is hereby corrected as shown below:

Please add claim 13.

13. A method of completely shielding electrically conductive members connecting at least two circuit boards by use of a shielded connector block apparatus, said block comprising a body having two substantially parallel exterior faces; a plurality of holes having interior surfaces, said holes formed through the parallel exterior faces of said body and adapted to receive at least one electrically conductive member; an electrically conductive coating covering at least the interior surfaces of said holes, said coating being in electrical communication between said holes; insulating means in at least one of said holes for insulating any electrically conductive members placed in said holes from said electrically conductive coating; said method comprising:

placing said block between at least two circuit boards;

UNITED STATES PATENT AND TRADEMARK OFFICE

CERTIFICATE OF CORRECTION

PATENT NO. : 5,211,567

DATED : May 8, 1993

INVENTOR(S) : Eugene F. Neumann, et al.

It is certified that error appears in the above-identified patent and that said Letters Patent is hereby corrected as shown below:

connecting selected circuits on said circuit boards via electrically conductive members placed in the holes of said block containing insulating means;

electrically connecting the coating of said block to a source of constant potential at selected locations in said block; and holding the electrically conductive coating on said block at a constant potential;

whereby said electrically conductive members in said block are shielded by the constant potential of the electrically conductive coating in each of the holes.

Signed and Sealed this

Seventeenth Day of May, 1994

*Attest:*

Bruce Lehman

BRUCE LEHMAN

*Attesting Officer*

*Commissioner of Patents and Trademarks*